US006058510A

United States Patent [19]

Breitenbach

[11] Patent Number: 6,058,510

[45] Date of Patent: May 9, 2000

[54] WORK GLOVE WITH WEB

[76] Inventor: Emil Breitenbach, 13 Phillips La., Aquebogue, N.Y. 11931

[21] Appl. No.: 09/258,331

[22] Filed: Feb. 25, 1999

[51] Int. Cl.[7] ..... A41D 19/00

[52] U.S. Cl. ..... 2/161.6; 2/160; 2/163; 56/400.01; 172/371; 441/57

[58] Field of Search ..... 2/159, 160, 161.6, 2/163, 167; 15/227; 172/370, 371, 372; 56/400.01; 441/56, 57

[56] References Cited

U.S. PATENT DOCUMENTS

| | | | |
|---|---|---|---|
| 689,840 | 12/1901 | Jensen | 2/161.1 |
| 3,593,803 | 7/1971 | Ibach | 172/370 |
| 4,149,601 | 4/1979 | Taylor | 172/370 |
| 4,203,495 | 5/1980 | Crownover | 172/370 |
| 4,474,246 | 10/1984 | Arroyo | 172/370 |
| 4,748,711 | 6/1988 | Markus | 15/227 |
| 5,887,283 | 3/1999 | Mackay | 2/161.6 |

*Primary Examiner*—Diana Oleksa
*Assistant Examiner*—Katherine Moran

[57] ABSTRACT

Provided is an apparatus including a plurality of finger mounts and a plurality of rods each having a base coupled to the tip of one of the finger mounts and extending therefrom in coaxial relationship therewith. A web is mounted on the rods for manipulating and/or collecting debris.

13 Claims, 2 Drawing Sheets

WORK GLOVE WITH WEB

BACKGROUND OF THE INVENTION

1. Field of the Invention

The present invention relates to work glove systems and more particularly pertains to a new work glove with web for collecting and manipulating debris.

2. Description of the Prior Art

The use of work glove systems is known in the prior art. More specifically, work glove systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,954,832; U.S. Pat. No. 4,867,246; U.S. Pat. No. 5,644,796; U.S. Pat. No. 2,895,139; U.S. Pat. No. 4,089,379; and U.S. Pat. Des. 378,869.

In these respects, the work glove with web according to the present invention substantially departs from the conventional concepts and designs of the prior art, and in so doing provides an apparatus primarily developed for the purpose of collecting and manipulating debris.

SUMMARY OF THE INVENTION

In view of the foregoing disadvantages inherent in the known types of work glove systems now present in the prior art, the present invention provides a new work glove with web construction wherein the same can be utilized for collecting and manipulating debris.

The general purpose of the present invention, which will be described subsequently in greater detail, is to provide a new work glove with web apparatus and method which has many of the advantages of the work glove systems mentioned heretofore and many novel features that result in a new work glove with web which is not anticipated, rendered obvious, suggested, or even implied by any of the prior art work glove systems, either alone or in any combination thereof.

To attain this, the present invention generally comprises a glove constructed from an air-permeable, flexible fabric material. As shown in FIG. 1, the glove includes a wrist portion, an intermediate portion, and a plurality of closed finger portions. Also included is a plurality of finger mounts each constructed from a flexible, resilient plastic material. Each finger mount is shaped with a generally conical configuration having a hollow interior and a blunt tip. As shown in FIGS. 1 & 2, the finger mounts each have one of the finger portions of the glove received therein and attached thereto. Next provided is a plurality of rods each constructed from the flexible, resilient plastic material similar to that from which the finger mounts are constructed. The rods each have a length of at least one foot. As shown in the Figures, the rods each have a base coupled to the tip of one of the finger mounts and extending therefrom in coaxial relationship therewith so as to terminate at a free end. Finally, a web is constructed from a flexible, elastic plastic material. As shown in the Figures, the web is equipped with a substantially rectangular configuration defined by a pair of elongated side edges and a pair of short end edges. The web is coupled to the rods such that an outboard one of the elongated side edges is coextensive with the free ends of the rods. Further, in a relaxed orientation, the rods reside in parallel with the short end edges of the web. In use, the fingers of the gloves may be separated when worn to expand the web to facilitate the collection of debris.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new work glove with web apparatus and method which has many of the advantages of the work glove systems mentioned heretofore and many novel features that result in a new work glove with web which is not anticipated, rendered obvious, suggested, or even implied by any of the prior art work glove systems, either alone or in any combination thereof.

It is another object of the present invention to provide a new work glove with web which may be easily and efficiently manufactured and marketed.

It is a further object of the present invention to provide a new work glove with web which is of a durable and reliable construction.

An even further object of the present invention is to provide a new work glove with web which is susceptible of a low cost of manufacture with regard to both materials and labor, and which accordingly is then susceptible of low prices of sale to the consuming public, thereby making such work glove with web economically available to the buying public.

Still yet another object of the present invention is to provide a new work glove with web which provides in the apparatuses and methods of the prior art some of the advantages thereof, while simultaneously overcoming some of the disadvantages normally associated therewith.

Still another object of the present invention is to provide a new work glove with web for collecting and manipulating debris.

Even still another object of the present invention is to provide a new work glove with web that includes a plurality of finger mounts and a plurality of rods each having a base coupled to the tip of one of the finger mounts and extending therefrom in coaxial relationship therewith. A web is mounted on the rods for manipulating and/or collecting debris.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
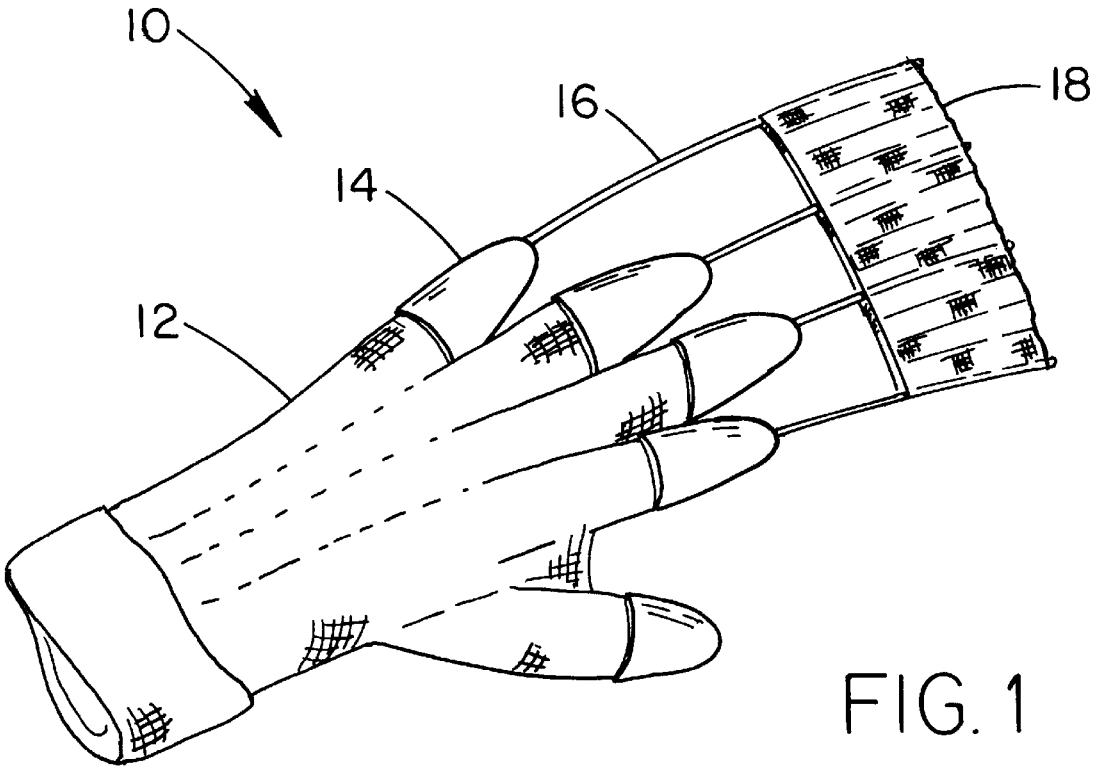
FIG. 1 is a top view of a new work glove with web according to the present invention.

With reference now to the drawings, and in particular to FIGS. 1 through 4 thereof, a new work glove with web embodying the principles and concepts of the present invention and generally designated by the reference numeral 10 will be described.

The present invention, designated as numeral 10, includes a glove 12 constructed from an air-permeable, flexible fabric material. As shown in FIG. 1, the glove includes a wrist portion, an intermediate portion, and a plurality of closed finger portions.

Figure 2:
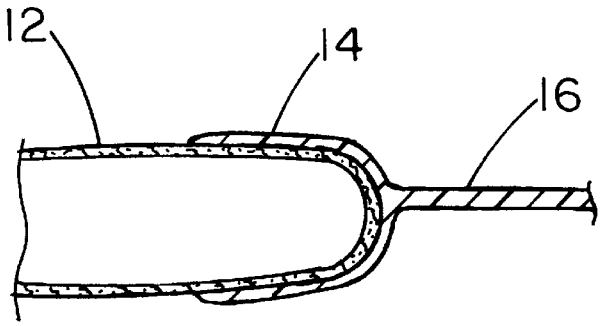
FIG. 2 is a side cross-sectional view of one of the finger mounts of the present invention.
Figure 3:
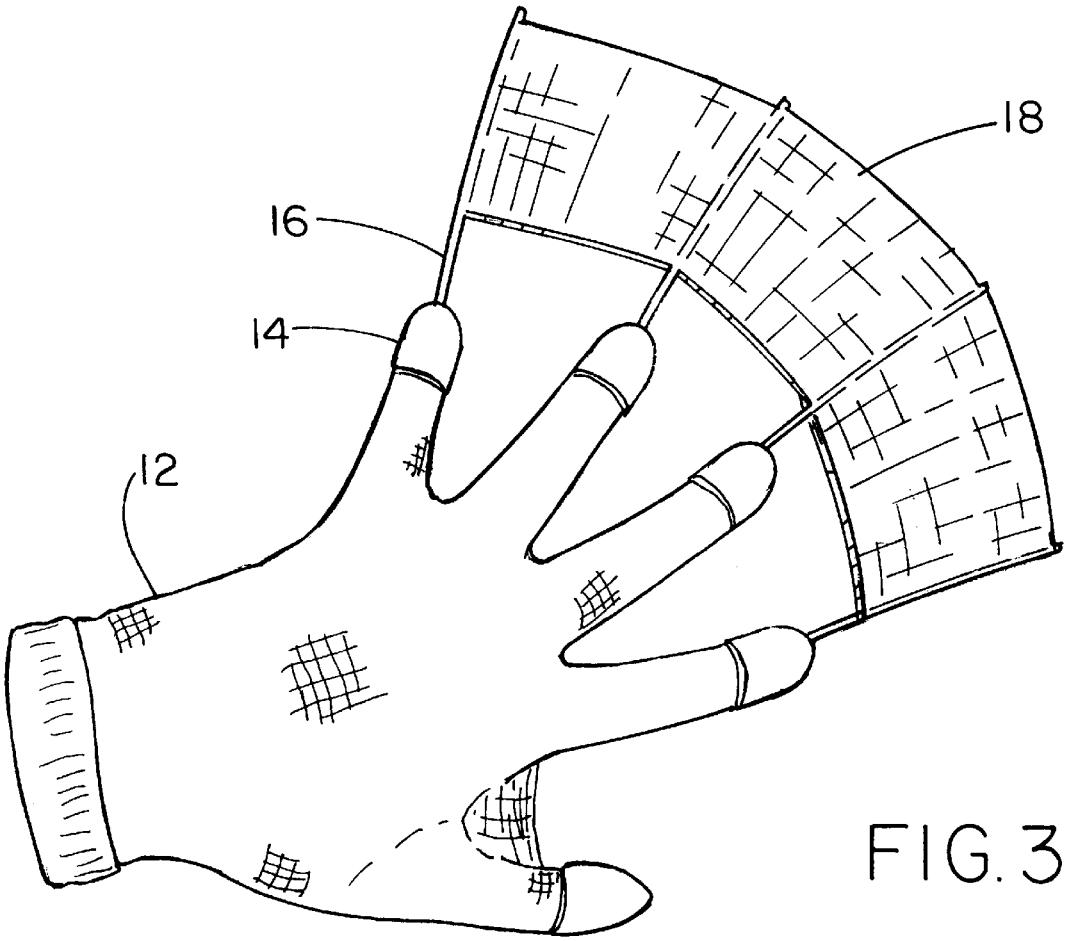
FIG. 3 is a top view of the present invention with the web in an expanded orientation.
Figure 4:
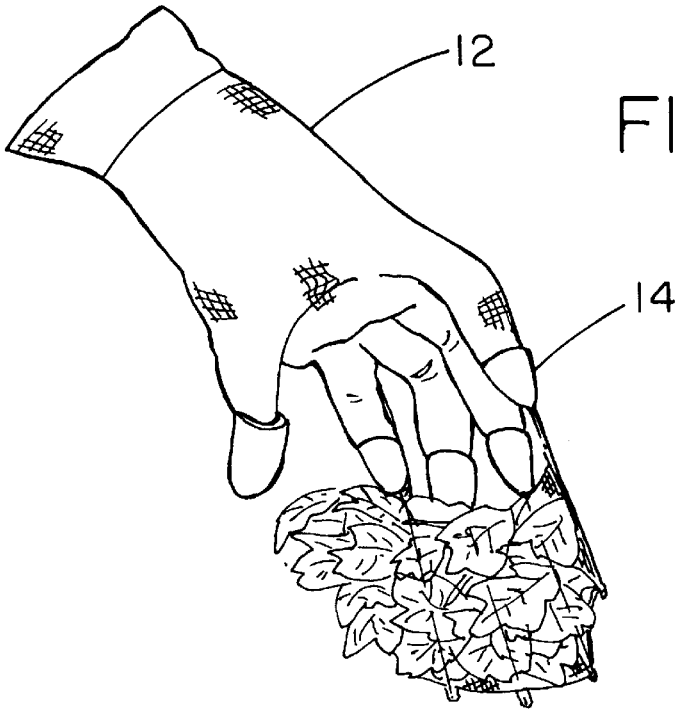
FIG. 4 is a perspective view of the present invention in use.

Also included is a plurality of finger mounts 14 each constructed from a flexible, resilient plastic material. Each finger mount is shaped with a generally conical configuration having a hollow interior and a blunt tip. As shown in FIGS. 1 & 2, the finger mounts each have one of the finger portions of the glove received therein and attached thereto. Ideally, the finger mounts extend to at least the first knuckle of the user.

Next provided is a plurality of rods 16 each constructed from the flexible, resilient plastic material similar to that from which the finger mounts are constructed. The rods each have a length of at least one foot. As shown in the Figures, the rods each have a base coupled to the tip of one of the finger mounts and extending therefrom in coaxial relationship therewith so as to terminate at a free end.

Finally, a web 18 is constructed from a flexible, elastic plastic material. As shown in the Figures, the web is equipped with a substantially rectangular configuration defined by a pair of elongated side edges and a pair of short end edges. The web is coupled to the rods such that an outboard one of the elongated side edges is coextensive with the free ends of the rods. Further, in a relaxed orientation, the rods reside in parallel with the short end edges of the web. Ideally, an inboard one of the elongated side edges of the web terminates short of the finger mounts, as shown in FIG. 1. In use, the fingers of the gloves may be separated when worn to expand the web to facilitate the collection of debris commonly encountered during yard work.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A work glove system comprising, in combination:

a glove constructed from an air-permeable, flexible fabric material and including a wrist portion, an intermediate portion, and a plurality of closed finger portions;

a plurality of finger mounts each constructed from a flexible, resilient plastic material, each finger mount being shaped with a generally conical configuration having a hollow interior and a blunt tip, the finger mounts each having one of the finger portions of the glove received therein and attached thereto;

a plurality of rods each constructed from the flexible, resilient plastic material and having a length of at least one foot, the rods each having a base coupled to the tip of one of the finger mounts and extending therefrom in coaxial relationship therewith so as to terminate at a free end; and a web constructed from a flexible, elastic plastic material and having a substantially rectangular configuration defined by a pair of elongated side edges and a pair of short end edges, the web being coupled to the rods such that an outboard one of the elongated side edges is coextensive with the free ends of the rods and the rods reside in parallel with the short end edges of the web, wherein the fingers of the gloves may be separated when worn to expand the web.

2. An apparatus comprising:

a plurality of finger mounts;

a plurality ol rods each having a base coupled to the tip of one of the finger mounts and extending therefrom in coaxial relationship therewith; and a web mounted on the rods for manipulating debris;

wherein the web has a substantially rectangular configuration defined by a pair of elongated side edges and a pair of short end edges, the web being coupled to the rods such that an outboard one of the elongated side edges is coextensive with the free ends of the rods and the rods reside in parallel with the short end edges of the web.

3. The apparatus as set forth in claim 2 wherein the web is constructed from a flexible, elastic plastic material.

4. The apparatus as set forth in claim 2 wherein the rods are constructed from a flexible, resilient plastic material.

5. The apparatus as set forth in claim 2 wherein at least one of the rods has a length of at least one foot.

6. The apparatus as set forth in claim 2 and further including a glove including a wrist portion, an intermediate portion, and a plurality of closed finger portions, wherein the finger mounts each have one of the finger portions of the glove received therein and attached thereto.

7. The apparatus as set forth in claim 2 wherein the finger mounts are each constructed from a flexible, resilient plastic material, each finger mount being shaped with a generally conical configuration having a hollow interior and a blunt tip.

8. An apparatus comprising:

a plurality of finger mounts;

a plurality of rods each having a base coupled to the tip of one of the finger mounts and extending therefrom in coaxial relationship therewith;

a web mounted on the rods for manipulating debris; and a glove including a wrist portion, an intermediate portion, and a plurality of closed finger portions, wherein the finger mounts each have one of the finger portions of the glove received therein and attached thereto.

9. The apparatus as set forth in claim 8 wherein the web is constructed from a flexible, elastic plastic material.

10. The apparatus as set forth in claim 8 wherein the web has a substantially rectangular configuration defined by a pair of elongated side edges and a pair of short end edges, the web being coupled to the rods such that an outboard one of the elongated side edges is coextensive with the free ends of the rods and the rods reside in parallel with the short end edges of the web.

11. The apparatus as set forth in claim 8 wherein the rods are constructed from a flexible, resilient plastic material.

12. The apparatus as set forth in claim 8 wherein at least one of the rods has a length of at least one foot.

13. The apparatus as set forth in claim 8 wherein the finger mounts are each constructed from a flexible, resilient plastic material, each finger mount being shaped with a generally conical configuration having a hollow interior and a blunt tip.

* * * * *